US008026876B2

(12) United States Patent
Nathan et al.

(10) Patent No.: US 8,026,876 B2
(45) Date of Patent: Sep. 27, 2011

(54) OLED LUMINANCE DEGRADATION COMPENSATION

(75) Inventors: Arokia Nathan, Cambridge (GB); G. Reza Chaji, Waterloo (CA)

(73) Assignee: Ignis Innovation Inc., Kitchener (CA)

( * ) Notice: Subject to any disclaimer, the term of this patent is extended or adjusted under 35 U.S.C. 154(b) by 1018 days.

(21) Appl. No.: 11/839,145

(22) Filed: Aug. 15, 2007

(65) Prior Publication Data

US 2008/0088648 A1 Apr. 17, 2008

(30) Foreign Application Priority Data

Aug. 15, 2006 (CA) ..... 2556961

(51) Int. Cl.
*G09G 3/30* (2006.01)

(52) U.S. Cl. ..... 345/78; 345/76; 315/169.3

(58) Field of Classification Search ..... 345/76–83, 345/204–215; 315/169.1–169.4
See application file for complete search history.

(56) References Cited

U.S. PATENT DOCUMENTS

| | | | |
|---|---|---|---|
| 4,354,162 | A | 10/1982 | Wright |
| 5,589,847 | A | 12/1996 | Lewis |
| 5,670,973 | A | 9/1997 | Bassetti et al. |
| 5,748,160 | A | 5/1998 | Shieh et al. |
| 5,815,303 | A | 9/1998 | Berlin |
| 6,097,360 | A | 8/2000 | Holloman |
| 6,259,424 | B1 | 7/2001 | Kurogane |
| 6,262,589 | B1 * | 7/2001 | Tamukai ..... 324/770 |
| 6,288,696 | B1 | 9/2001 | Holloman |
| 6,320,325 | B1 | 11/2001 | Cok et al. |
| 6,414,661 | B1 | 7/2002 | Shen et al. |
| 6,580,657 | B2 | 6/2003 | Sanford et al. |
| 6,594,606 | B2 | 7/2003 | Everitt |
| 6,618,030 | B2 | 9/2003 | Kane et al. |
| 6,687,266 | B1 | 2/2004 | Ma et al. |
| 6,690,344 | B1 | 2/2004 | Takeuchi et al. |
| 6,693,388 | B2 | 2/2004 | Oomura |
| 6,720,942 | B2 | 4/2004 | Lee et al. |
| 6,738,035 | B1 | 5/2004 | Fan |
| 6,771,028 | B1 | 8/2004 | Winters |
| 6,777,712 | B2 | 8/2004 | Sanford et al. |
| 6,806,638 | B2 | 10/2004 | Lin et al. |
| 6,809,706 | B2 | 10/2004 | Shimoda |
| 6,909,419 | B2 | 6/2005 | Zavracky et al. |
| 6,937,215 | B2 | 8/2005 | Lo |
| 6,943,500 | B2 | 9/2005 | LeChevalier |
| 6,995,510 | B2 | 2/2006 | Murakami et al. |

(Continued)

FOREIGN PATENT DOCUMENTS

CA 1 294 034 1/1992

(Continued)

OTHER PUBLICATIONS

Alexander et al.: "Pixel circuits and drive schemes for glass and elastic AMOLED displays"; dated Jul. 2005 (9 pages).

(Continued)

*Primary Examiner* — Alexander Eisen
*Assistant Examiner* — Patrick Marinelli
(74) *Attorney, Agent, or Firm* — Nixon Peabody LLP

(57) ABSTRACT

A system and method are disclosed for determining a pixel capacitance. The pixel capacitance is correlated to a pixel age to determine a current correction factor used for compensating the pixel drive current to account for luminance degradation of the pixel that results from the pixel aging.

14 Claims, 7 Drawing Sheets

U.S. PATENT DOCUMENTS

| | | | | |
|---|---|---|---|---|
| 6,995,519 | B2 | 2/2006 | Arnold et al. | |
| 7,027,015 | B2 | 4/2006 | Booth, Jr. et al. | |
| 7,034,793 | B2 | 4/2006 | Sekiya et al. | |
| 7,106,285 | B2 | 9/2006 | Naugler | |
| 7,119,493 | B2 * | 10/2006 | Fryer et al. | 315/169.3 |
| 7,274,363 | B2 | 9/2007 | Ishizuka et al. | |
| 7,321,348 | B2 | 1/2008 | Cok et al. | |
| 7,355,574 | B1 * | 4/2008 | Leon et al. | 345/82 |
| 7,502,000 | B2 | 3/2009 | Yuki et al. | |
| 7,535,449 | B2 | 5/2009 | Miyazawa | |
| 7,554,512 | B2 | 6/2009 | Steer | |
| 7,619,594 | B2 | 11/2009 | Hu | |
| 7,619,597 | B2 | 11/2009 | Nathan et al. | |
| 2002/0084463 | A1 | 7/2002 | Sanford et al. | |
| 2002/0101172 | A1 | 8/2002 | Bu | |
| 2002/0105279 | A1 * | 8/2002 | Kimura | 315/169.3 |
| 2002/0158823 | A1 | 10/2002 | Zavracky et al. | |
| 2002/0169575 | A1 * | 11/2002 | Everitt | 702/107 |
| 2002/0186214 | A1 | 12/2002 | Siwinski | |
| 2002/0190971 | A1 | 12/2002 | Nakamura et al. | |
| 2002/0195967 | A1 | 12/2002 | Kim et al. | |
| 2003/0020413 | A1 | 1/2003 | Oomura | |
| 2003/0030603 | A1 | 2/2003 | Shimoda | |
| 2003/0057895 | A1 * | 3/2003 | Kimura | 315/370 |
| 2003/0076048 | A1 | 4/2003 | Rutherford | |
| 2003/0142088 | A1 * | 7/2003 | LeChevalier | 345/211 |
| 2003/0151569 | A1 | 8/2003 | Lee et al. | |
| 2003/0179626 | A1 | 9/2003 | Sanford et al. | |
| 2004/0066357 | A1 | 4/2004 | Kawasaki | |
| 2004/0135749 | A1 | 7/2004 | Kondakov et al. | |
| 2004/0183759 | A1 | 9/2004 | Stevenson et al. | |
| 2004/0189627 | A1 | 9/2004 | Shirasaki et al. | |
| 2004/0257355 | A1 | 12/2004 | Naugler | |
| 2004/0263444 | A1 * | 12/2004 | Kimura | 345/82 |
| 2004/0263445 | A1 * | 12/2004 | Inukai et al. | 345/82 |
| 2005/0024081 | A1 * | 2/2005 | Kuo et al. | 324/770 |
| 2005/0030267 | A1 * | 2/2005 | Tanghe et al. | 345/82 |
| 2005/0110420 | A1 | 5/2005 | Arnold et al. | |
| 2005/0140610 | A1 | 6/2005 | Smith et al. | |
| 2005/0145891 | A1 | 7/2005 | Abe | |
| 2005/0156831 | A1 | 7/2005 | Yamazaki et al. | |
| 2006/0038758 | A1 | 2/2006 | Routley et al. | |
| 2006/0077135 | A1 * | 4/2006 | Cok et al. | 345/76 |
| 2006/0170623 | A1 * | 8/2006 | Naugler et al. | 345/76 |
| 2006/0232522 | A1 | 10/2006 | Roy et al. | |
| 2007/0080908 | A1 | 4/2007 | Nathan et al. | |
| 2007/0182671 | A1 | 8/2007 | Nathan et al. | |

FOREIGN PATENT DOCUMENTS

| | | | |
|---|---|---|---|
| CA | 2 368 386 | | 9/1999 |
| CA | 2 432 530 | | 7/2002 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| EP | 1 194 013 | | 3/2002 |
| EP | 1 335 430 | A1 | 8/2003 |
| EP | 1 381 019 | | 1/2004 |
| EP | 1 521 203 | A2 | 4/2005 |
| JP | 10-254410 | | 9/1998 |
| JP | 2002-278513 | | 9/2002 |
| JP | 2003-076331 | | 3/2003 |
| JP | 2003-308046 | | 10/2003 |
| WO | 9948079 | | 9/1999 |
| WO | 01/27910 | A1 | 4/2001 |
| WO | 03/034389 | | 4/2003 |
| WO | 03/063124 | | 7/2003 |
| WO | 2004/003877 | | 1/2004 |
| WO | 2004/034364 | | 4/2004 |
| WO | 2005/022498 | | 3/2005 |
| WO | 2005/055185 | | 6/2005 |
| WO | 2006/063448 | | 6/2006 |

OTHER PUBLICATIONS

Ashtiani et al.: "AMOLED Pixel Circuit With Electronic Compensation of Luminance Degradation"; dated Mar. 2007 (4 pages).

Chahi et al.: "An Enhanced and Simplified Optical Feedback Pixel Circuit for AMOLED Displays"; dated Oct. 2006.

Chaji et al.: "A Low-Cost Stable Amorphous Silicon AMOLED Display with Full V~T- and V~O~L~E~D Shift Compensation"; dated May 2007 (4 pages).

Chaji et al.: "A low-power driving scheme for a-Si:H active-matrix organic light-emitting diode displays"; dated Jun. 2005 (4 pages).

Chaji et al.: "A low-power high-performance digital circuit for deep submicron technologies"; dated Jun. 2005 (4 pages).

Chaji et al.: "A novel a-Si:H AMOLED pixel circuit based on short-term stress stability of a-Si:H TFTs"; dated Oct. 2005 (3 pages).

Chaji et al.: "A Novel Driving Scheme and Pixel Circuit for AMOLED Displays"; dated Jun. 2006 (4 pages).

Chaji et al.: "A novel driving scheme for high-resolution large-area a-Si:H AMOLED displays"; dated Aug. 2005 (4 pages).

Chaji et al.: "A Stable Voltage-Programmed Pixel Circuit for a-Si:H AMOLED Displays"; dated Dec. 2006 (12 pages).

Chaji et al.: "Driving scheme for stable operation of 2-TFT a-Si AMOLED pixel"; dated Apr. 2005 (2 pages).

Chaji et al.: "Dynamic-effect compensating technique for stable a-Si:H AMOLED displays"; dated Aug. 2005 (4 pages).

Chaji et al.: "eUTDSP: a design study of a new VLIW-based DSP architecture"; dated May 2003 (4 pages).

Chaji et al.: "High Speed Low Power Adder Design With A New Logic Style: Pseudo Dynamic Logic (SDL)"; dated Oct. 2001 (4 pages).

Chaji et al.: "High-precision, fast current source for large-area current-programmed a-Si flat panels"; dated Sep. 2006 (4 pages).

Chaji et al.: "Low-Cost Stable a-Si:H AMOLED Display for Portable Applications"; dated Jun. 2006 (4 pages).

Chaji et al.: "Parallel Addressing Scheme for Voltage-Programmed Active-Matrix OLED Displays"; dated May 2007 (6 pages).

Chaji et al.: "Pseudo dynamic logic (SDL): a high-speed and low-power dynamic logic family"; dated 2002 (4 pages).

Chaji et al.: "Stable a-Si:H circuits based on short-term stress stability of amorphous silicon thin film transistors"; dated May 2006 (4 pages).

European Search Report for European Application No. EP 07 81 5784 dated Jul. 20, 2010 (2 pages).

Goh et al., "A New a-Si:H Thin Film Transistor Pixel Circul for Active-Matrix Organic Light-Emitting Diodes", IEEE Electron Device Letters, vol. 24, No. 9, Sep. 2003, 4 pages.

Jafarabadiashtiani et al.: "A New Driving Method for a-Si AMOLED Displays Based on Voltage Feedback"; May 27, 2005 (4 pages).

Lee et al.: "Ambipolar Thin-Film Transistors Fabricated by PECVD Nanocrystalline Silicon"; dated 2006 (6 pages).

Matsueda y et al.: "35.1: 2.5-in. AMOLED with Integrated 6-bit Gamma Compensated Digital Data Driver"; dated May 2004 (4 pages).

Nathan et al., "Amorphous Silicon Thin Film Transistor Circuit Integration for Oganic LED Displays on Glass and Plastic", IEEE Journal of Solid-State Circuits, vol. 39, No. 9, Sep. 2004, 12 pages.

Nathan et al.: "Backplane Requirements for Active Matrix Organic Light Emitting Diode Displays"; dated 2006 (16 pages).

Nathan et al.: "Driving schemes for a-Si and LTPS AMOLED displays"; dated Dec. 2005 (11 pages).

Nathan et al.: "Invited Paper: a -Si for AMOLED—Meeting the Performance and Cost Demands of Display Applications (Cell Phone to HDTV)"; dated 2006 (4 pages).

Philipp, Hal: "Charge transfer sensing"; dated Dec. 1999 (10 pages).

Rafati et al.: "Comparison of a 17 b multiplier in Dual-rail domino and in Dual-rail D L (D L) logic styles"; dated 2002 (4 pages).

Safavaian et al.: "Three-TFT image sensor for real-time digital X-ray imaging"; dated Feb. 2, 2006 (2 pages).

Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.

* cited by examiner

OLED LUMINANCE DEGRADATION COMPENSATION

FIELD OF THE INVENTION

The present invention relates to OLED displays, and in particular to the compensation of luminance degradation of the OLED based on OLED capacitance.

BACKGROUND

Organic light emitting diodes ("OLEDs") are known to have many desirable qualities for use in displays. For example, they can produce bright displays, they can be manufactured on flexible substrates, they have low power requirements, and they do not require a backlight. OLEDs can be manufactured to emit different colours of light. This makes possible their use in full colour displays. Furthermore, their small size allows for their use in high resolution displays.

The use of OLEDs in displays is currently limited by, among other things, their longevity. As the OLED display is used, the luminance of the display decreases. In order to produce a display that can produce the same quality of display output repeatedly over a period of time (for example, greater then 1000 hours) it is necessary to compensate for this degradation in luminance.

One method of determining the luminance degradation is by measuring it directly. This method measures the luminance of a pixel for a given driving current. This technique requires a portion of each pixel to be covered by the light detector. This results in a lower aperture and resolution.

Another technique is to predict the luminance degradation based on the accumulated drive current applied to the pixel. This technique suffers in that if the information pertaining to the accumulated drive current is lost or corrupted (such as by power failure) the luminance correction cannot be performed.

There is therefore a need for a method and associated system for determining the luminance degradation of an OLED that does not result in a decrease in the aperture ratio, yield or resolution and that does not rely on information about the past operation of the OLED to compensate for the degradation.

SUMMARY

In one embodiment there is provided a method of compensating for luminance degradation of a pixel. The method comprises determining the capacitance of the pixel, and correlating the determined capacitance of the pixel to a current correction factor for the pixel.

In another embodiment there is provided a method of driving a pixel with a current compensated for luminance degradation of the pixel. The method comprises determining the capacitance of the pixel, correlating the determined capacitance of the pixel to a current correction factor for the pixel, compensating a pixel drive current according to the current correction factor, and driving the pixel with the compensated current.

In yet another embodiment there is provided a read block for use in determining a pixel capacitance of a plurality of pixel circuits. The pixel circuits are arranged in an array to form a display. The read block comprises a plurality of read block elements. Each read block element comprises a switch for electrically connecting and disconnecting the read block element to a pixel circuit of the plurality of pixels circuits, an operational amplifier electrically connected to the switch and a read capacitor connected in parallel with the operational amplifier.

In still another embodiment there is provided a display for driving an array of a plurality of pixel circuits with a current compensated for luminance degradation. The display comprises a display panel comprising the array of pixel circuits, the pixel circuits arranged in at least one row and a plurality of columns, a column driver for driving the pixel circuits with a driving current, a read block for determining a pixel capacitance of the pixel circuits, and a control block for controlling the operation of the column driver and the read block, the control block operable to determine a current correction factor from the determined pixel capacitance and to adjust the driving current based on the current correction factor.

BRIEF DESCRIPTION OF THE DRAWINGS

Features and embodiments will be described with reference to the drawings wherein.

DETAILED DESCRIPTION

Figure 1:
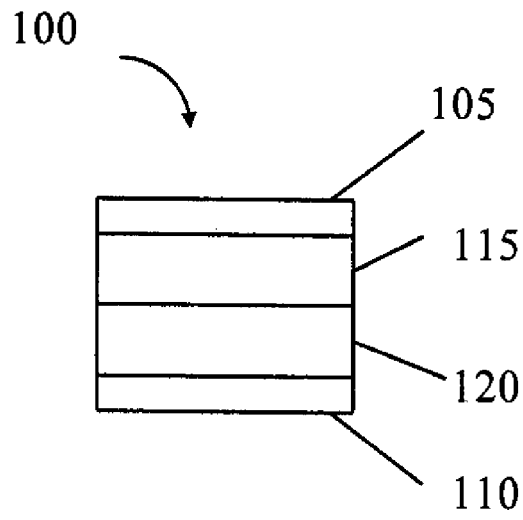
FIG. 1 is a block diagram illustrating the structure of an organic light emitting diode.

FIG. 1 shows, in a block diagram, the structure of an organic light emitting diode ("OLED") 100. The OLED 100 may be used as a pixel in a display device. The following description refers to pixels, and will be appreciated that the pixel may be an OLED. The OLED 100 comprises two electrodes, a cathode 105 and an anode 110. Sandwiched between the two electrodes are two types of organic material. The organic material connected to the cathode 105 is an emissive layer and is typically referred to as a hole transport layer 115. The organic material connected to the anode 110 is a conductive layer and is typically referred to as an electron transport layer 120. Holes and electrons may be injected into the organic materials at the electrodes 105, 110. The holes and electrons recombine at the junction of the two organic materials 115, 120 resulting in the emission of light.

The anode 110 may be made of a transparent material such as indium tin oxide. The cathode 105 does not need to be made of a transparent material. It is typically located on the back of the display panel, and may be referred to as the back plane electronics. In addition to the cathode 105, the back plane electronics may also include transistors and other elements used to control the functioning of the individual pixels.

Figure 2:
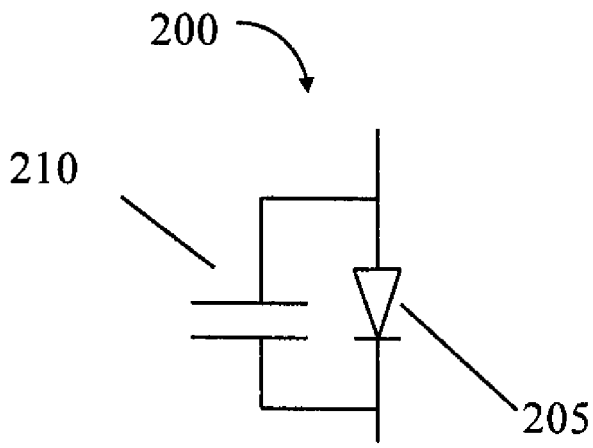
FIG. 2 is a schematic illustrating a circuit model of an OLED pixel.

FIG. 2 shows, in a schematic, a circuit model of an OLED pixel 200. The pixel may be modeled by an ideal diode 205 connected in parallel with a capacitor 210 having a capacitance $C_{oled}$. The capacitance is a result of the physical and electrical characteristics of the OLED. When a current passes through the diode 205 (if the diode is an LED) light is emitted. The intensity of the light emitted (the luminance of the pixel) depends on at least the age of the OLED and the current driving the OLED. As OLEDs age, as a result of being driven by a current for periods of time, the amount of current required to produce a given luminance increases.

In order to produce a display that can reproduce an output consistently over a period of time, the amount of driving current necessary to produce a given luminance must be determined. This requires accounting for the luminance degradation resulting from the aging of the pixel. For example, if a display is to produce an output of X cd/m$^2$ in brightness for 1000 hours, the amount of current required to drive each pixel in the display will increase as the pixels of the display age. The amount that the current must be increased by to produce the given luminance is referred to herein as a current correction factor. The current correction factor may be an absolute amount of current that needs to be added to the signal current in order to provide the compensated driving current to the pixel. Alternatively the current correction factor may be a multiplier. This multiplier may indicate for example that the signal current be doubled to account for the pixel aging. Alternatively the current correction factor may be used in a manner similar to a lookup table to directly correlate a signal current (or desired luminance) with a compensated driving current necessary to produce the desired luminance level in the aged pixel.

As described further herein it is possible to use the change of the pixel's capacitance over time as a feedback signal to stabilize the degradation of the pixel's luminance.

Figure 3A:
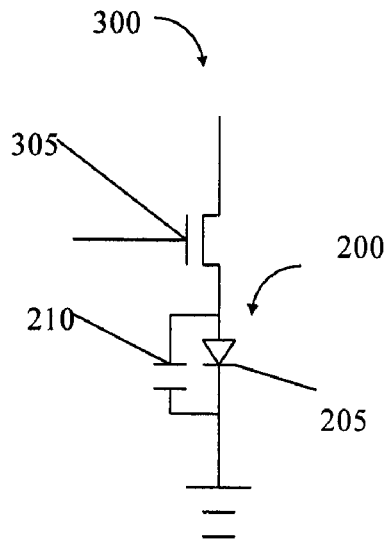
FIG. 3*a* is a schematic illustrating a simplified pixel circuit that can be used in a display.

FIG. 3*a* shows, in a schematic, a simplified pixel circuit 300 that can be used for driving a pixel 200. The transistor 305 acts as a switch for turning on the pixel 200 (shown in FIG. 2). A driving current passes through the transistor 305 to drive the output of the pixel 200.

Figure 3B:
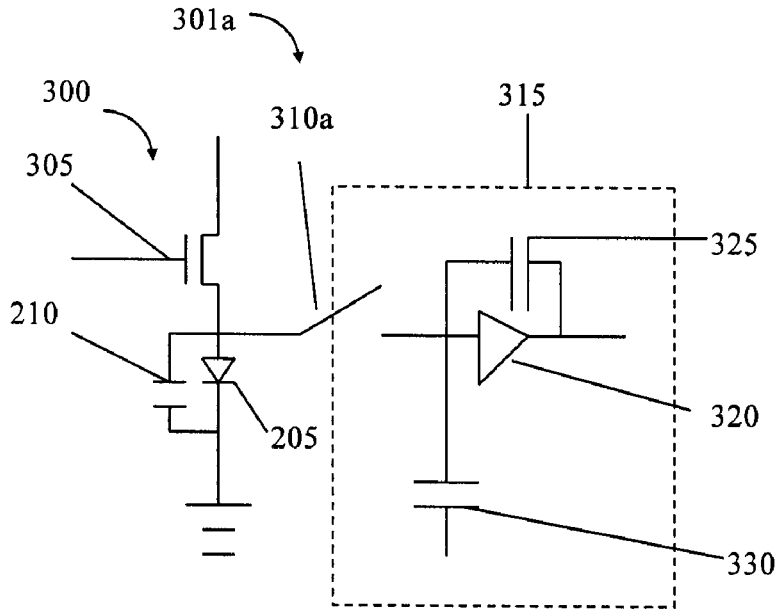
FIG. 3*b* is a schematic illustrating a modified and simplified pixel circuit.

FIG. 3*b* shows, in a schematic, a simplified pixel circuit 301*a*, which has been modified in accordance with methods of present invention. A read block 315 is connected to the pixel circuit 300 of FIG. 3*a* through a switch 310*a*. The read block 315 allows for the capacitance 210 of the pixel 200 to be determined. The read block 315 comprises an op amp 320 connected in parallel with a reading block capacitor 325. This configuration may be referred to as a charge amplifier. The circuit also has an inherent parasitic capacitance 330. The circuit elements of the read block 315 may be implemented in the display panel's back plane electronics. Alternatively, the read block elements may be implemented off the display panel. In one embodiment the read block 315 is incorporated into the column driving circuitry of the display.

If the read block 315 circuitry is implemented separately from the back plane circuitry of the display panel, the switch 310*a* may be implemented in the back plane electronics. Alternatively, the switch 310*a* may also be implemented in the separate read block 315. If the switch 310*a* is implemented in the separate read block 315 it is necessary to provide an electrical connection between the switch 310*a* and the pixel circuit 300.

Figure 3C:
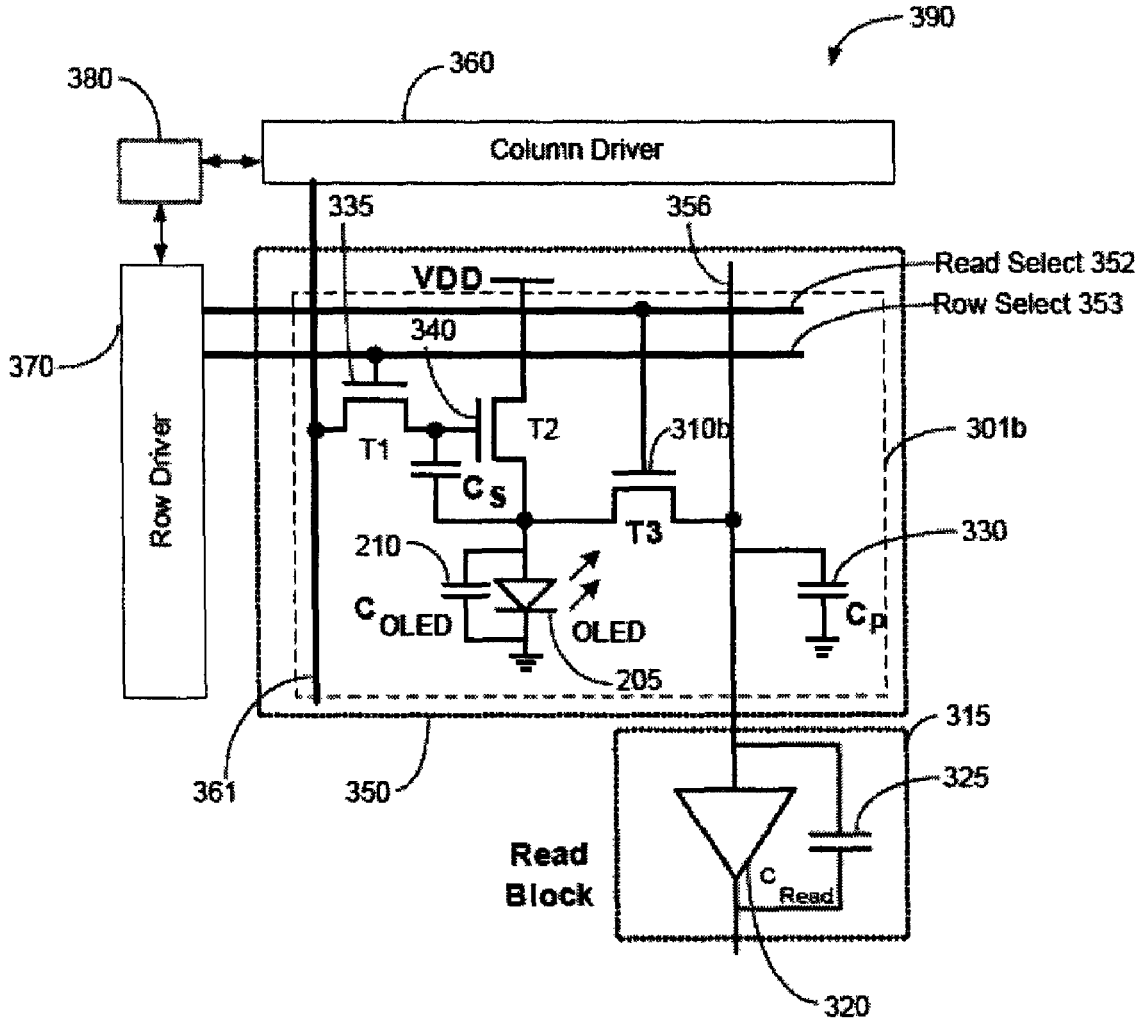
FIG. 3*c* is a schematic illustrating a display, comprising a single pixel.

FIG. 3*c* shows, in a schematic, a display 390, comprising a single pixel circuit 301*b* for clarity of the description. The display 390 comprises a row driver 370, a column driver 360, a control block 380, a display panel 350 and a read block 315. The read block 315 is shown as being a separate component. As previously described, it will be appreciated that the read block circuitry may be incorporated into the other components of the display 390.

The single transistor 305 controlling the driving of the pixel 200 shown in FIG. 3*b* is replaced with two transistors. The first transistor T1 335 acts as a switching transistor controlled by the row drivers 370. The second transistor T2 340 acts as a driving transistor to supply the appropriate current to the pixel 200. When T1 335 is turned on it allows the column drivers 360 to drive the pixel of pixel circuit 301*b* with the drive current (compensated for luminance degradation) through transistor T2 340. The switch 310*a* of FIG. 3*b* has been replaced with a transistor T3 310*b*. The control block 380 controls transistor T3 310*b*. Transistor T3 310*b* may be turned on and off to electrically connect the read block 315 to the pixel circuit.

The Row Select 353 and Read Select 352 lines may be driven by the row driver 370. The Row Select line 353 controls when a row of pixels is on. The Read Select line 352 controls the switch (transistor T3) 310 that connects the read block 315 with the pixel circuit. The Column Driver line 361 is driven by the column driver 360. The Column Driver line 361 provides the compensated driving current for driving the pixel 200 brightness. The pixel circuit also comprises a Read Block line 356. The pixel circuit is connected to the Read Block line 356 by the transistor T3 310*b*. The Read Block line 356 connects the pixel circuit to the read block 315.

The control block 380 of the display 390 controls the functioning of the various blocks of the display 390. The column driver 360 provides a driving current to the pixel 200. It will be appreciated that the current used to drive the pixel 200 determines the brightness of the pixel 200. The row drivers 370 determine which row of pixels will be driven by the column drivers 360 at a particular time. The control block 380 coordinates the column 360 and row drivers 370 so that a row of pixels is turned on and driven by an appropriate current at the appropriate time to produce a desired output. By controlling the row 370 and column drivers 360 (for example, when a particular row is turned on and what current drives each pixel in the row) the control block 380 controls the overall functioning of the display panel 350.

The display 390 of FIG. 3*c* may operate in at least two modes. The first mode is a typical display mode, in which the control block 380 controls the row 370 and column drivers 360 to drive the pixels 200 for displaying an appropriate output. In the display mode the read block 315 is not electrically connected to the pixel circuits as the control block 380 controls transistor T3 310*b* so that the transistor T3 310*b* is off. The second mode is a read mode, in which the control block 380 also controls the read block 315 to determine the capacitance of the pixel 200. In the read mode, the control block 380 turns on and off transistor T3 310*b* as required.

Figure 4:
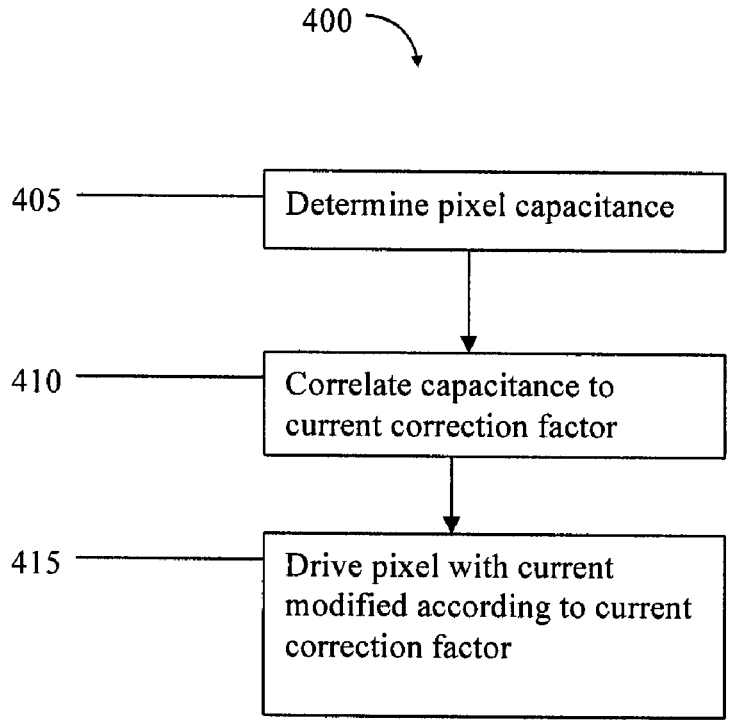
FIG. 4 is a flow diagram illustrating the steps for driving a pixel with a current compensated to account for the luminance degradation of the pixel.

FIG. 4 shows, in a flow diagram 400, the steps for driving a pixel with a current compensated to account for the luminance degradation of the pixel. The capacitance of the pixel is determined in step 405. The determined capacitance is then correlated to a current correction factor in step 410. This correlation may be done in various ways, such as through the solving of equations modeling the aging of the pixel type, or through a lookup means for directly correlating a capacitance to a current correction factor in step 415.

When determining the capacitance of a pixel of a display as shown in FIG. 3*c*, the switch is initially closed (transistor T3 310*b* is on), electrically connecting the pixel circuit to the read block 315 through the Read Block line 356, and the capacitance 210 of the pixel is charged to an initial voltage V1 determined by the bias voltage of the read block 315 (e.g. charge amplifier). The switch is then opened (transistor T3 is turned off), disconnecting the pixel circuit from the Read Block line 356 and in turn the read block 315. The parasitic capacitance 330 of the read block 315 (or Read Block line 356) is then charged to another voltage V2, determined by the bias voltage of the read block 315 (e.g. charge amplifier). The bias voltage of read block 315 (e.g. charge amplifier) is controlled by the control block 380, and may therefore be different from the voltage used to charge the pixel capacitance 210. Finally, the switch is closed again, electrically connecting the read block 315 to the pixel circuit. The pixel capacitance 210 is then charged to V2. The amount of charge required to change the voltage at $C_{oled}$ from V1 to V2 is stored in the read capacitor 325 which can be read as a voltage.

The accuracy of the method may be increased by waiting for a few micro seconds between the time the parasitic capacitance 330 is charged to voltage V2 and when the switch 310 is closed to electrically connect the read block 315 to the pixel circuit. In the few microseconds the leakage current of the read capacitor 315 can be measured, a resultant voltage determined and deducted from the final voltage seen across the read capacitor 315.

The change in voltage across the read capacitor 315 is measured once the switch 310 is closed. Once the pixel capacitance 210 and the parasitic capacitance 330 are charged to the same voltage, the voltage change across the read capacitor 325 may be used to determine the capacitance 210 of the pixel 200. The voltage change across the read capacitor 325 changes according to the following equation:

$$\Delta Vc_{read} = -\frac{C_{oled}}{C_{read}}(V1 - V2)$$

where:

$\Delta V_{Cread}$ is the voltage change across the read capacitor 325 from when the switch 310 is closed, connecting the charged parasitic 330 and pixel capacitances 210, to when the voltage across the two capacitances is equal;

$C_{oled}$ is the capacitance 210 of the pixel (in this case an OLED);

$C_{read}$ is the capacitance of the read capacitor 325;

V1 is the voltage that the pixel capacitance 210 is initially charged to; and V2 is the voltage that the parasitic capacitance 330 is charged to once the switch is opened.

The voltages V1 and V2 will be known and may be controlled by the control block 380. $C_{read}$ is known and may be selected as required to meet specific circuit design requirements. $\Delta Vc_{read}$ is measured from the output of the op amp 320. From the above equation, it is clear that as $C_{oled}$ decreases, $\Delta Vc_{read}$ decreases as well. Furthermore the gain is determined by V1, V2 and $C_{read}$. The values of V1 and V2 may be controlled by the control block 380 (or wherever the circuit is that controls the voltage). It will be appreciated that the measurement may be made by converting the analog signal of the op amp 320 into a digital signal using techniques known by those skilled in the art.

Figure 5:
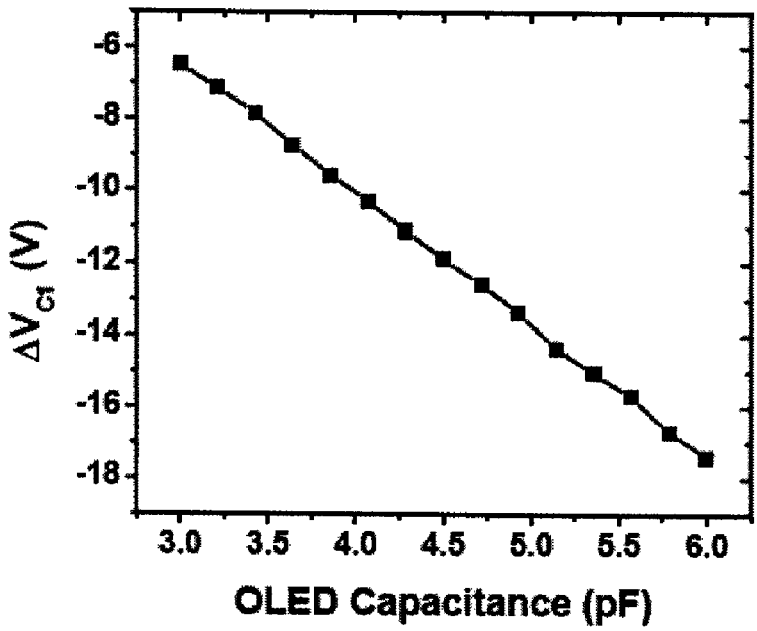
FIG. 5 is a graph illustrating the simulated change in voltage across the read capacitor using the read block circuit.

FIG. 5 shows, in a graph, the simulated change in voltage across the read capacitor 325 using the read block 315 circuit described above. From the graph it is apparent that the read block 315 may be used to determine the capacitance 210 of the pixel 200 based on the measured voltage change across the read capacitor 325.

Once the capacitance 210 of the pixel 200 is determined it may be used to determine the age of the pixel 200. As previously described, the relationship between the capacitance 210 and age of a pixel 200 may be determined experimentally for different pixel types by stressing the pixels with a given current and measuring the capacitance of the pixel periodically. The particular relationship between the capacitance and age of a pixel will vary for different pixel types and sizes and can be determined experimentally to ensure an appropriate correlation can be made between the capacitance and the age of the pixel.

The read block 315 may contain circuitry to determine the capacitance 210 of the pixel 200 from the output of the operational amplifier 320. This information would then be provided to the control block 380 for determining the current correction factor of the pixel 200. Alternatively, the output of the operational amplifier 320 of the read block 315 may be provided back to the control block 380. In this case, the control block 380 would comprise the circuitry and logic necessary to determine the capacitance 210 of the pixel 200 and the resultant current correction factor.

Figure 6:
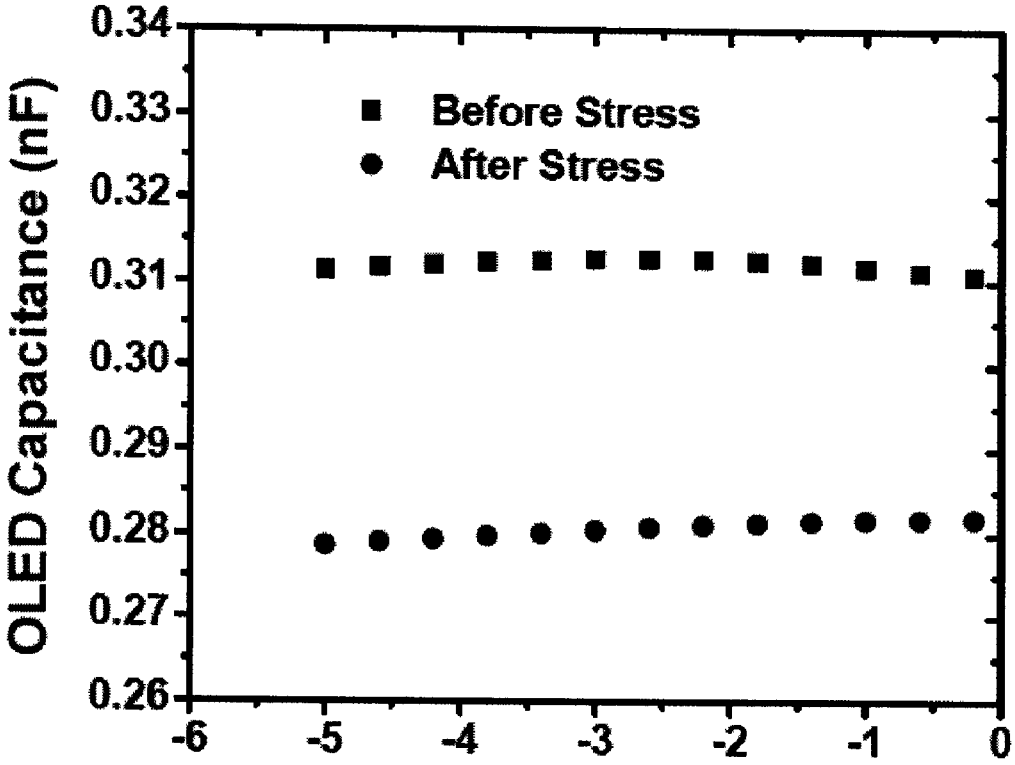
FIG. 6 is a graph illustrating the relationship between the capacitance and voltage of a pixel of different ages.

FIG. 6 shows, in a graph, the relationship between the capacitance and voltage of a pixel before and after aging. The aging was caused by stressing the pixel with a constant current of 20 mA/cm$^2$ for a week. The capacitance may be linearly related to the age. Other relationships are also possible, such as a polynomial relationship. Additionally, the relationship may only be able to be represented correctly by experimental measurements. In this case additional measurements are required to ensure that the modeling of the capacitance-age characteristics are accurate.

Figure 7:
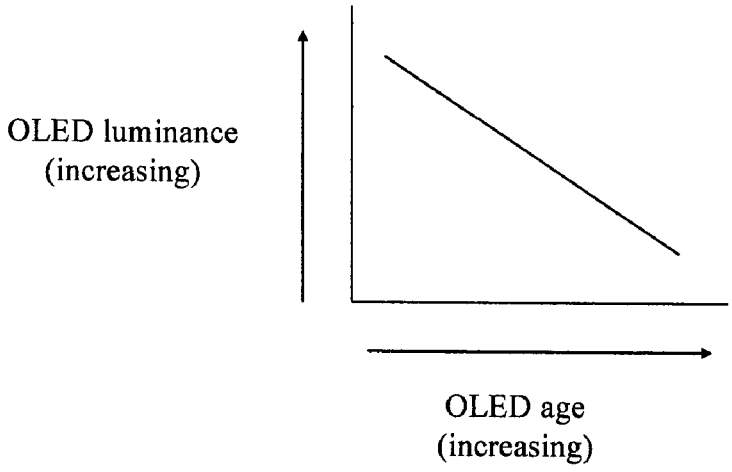
FIG. 7 is a graph illustrating the relationship between the luminance and age of a pixel.

FIG. 7 shows, in a graph, the relationship between the luminance and age of a pixel. This relationship may be determined experimentally when determining the capacitance of the pixel. The relationship between the age of the pixel and the current required to produce a given luminance may also be determined experimentally. The determined relationship between the age of the pixel and the current required to produce a given luminance may then be used to compensate for the aging of the pixel in the display.

A current correction factor may be used to determine the appropriate current at which to drive a pixel in order to produce the desired luminance. For example, it may be determined experimentally that in order to produce the same luminance in a pixel that has been aged (for example by driving it with a current of 15 mA/cm$^2$ for two weeks) as that of a new pixel, the aged pixel must be driven with 1.5 times the current. It is possible to determine the current required for a given luminance at two different ages, and assume that the aging is a linear relationship. From this, the current correction factor may be extrapolated for different ages. Furthermore, it may be assumed that the current correction factor is the same at different luminance levels for a pixel of a given age. That is, in order to produce a luminance of X cd/m$^2$ requires a current correction factor of 1.1 and that in order to produce a luminance of 2X cd/m$^2$ also requires a current correction factor of 1.1 for a pixel of a given age. Making these assumptions reduces the amount of measurements that are required to be determined experimentally.

Additional information may be determined experimentally, which results in not having to rely on as many assumptions. For example the pixel capacitance 210 may be determined at four different pixel ages (it is understood that the capacitance could be determined at as many ages as required to give the appropriate accuracy). The aging process may then be modeled more accurately, and as a result the extrapolated age may be more accurate. Additionally, the current correction factor for a pixel of a given age may be determined for different luminance levels. Again, the additional measurements make the modeling of the aging and current correction factor more accurate.

It will be appreciated that the amount of information obtained experimentally may be a trade off between the time necessary to make the measurements, and the additional accuracy the measurements provide.

Figure 8:
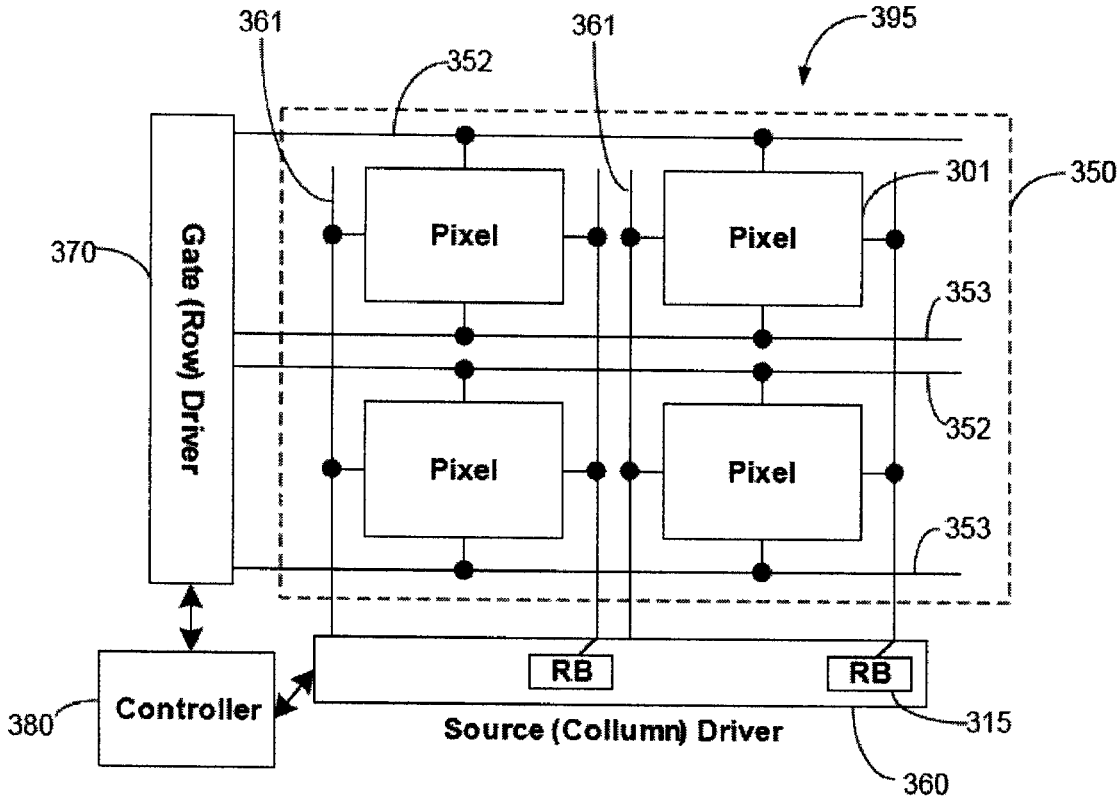
FIG. 8 is a block diagram illustrating a display.

FIG. 8 shows, in a block diagram, a display 395. The display 395 comprises a display panel 350, a row driver block 370, a column driver block 360 and a control block 380. The display panel 350 comprises an array of pixel circuits 301*b* arranged in row and columns. The pixel circuits 301*a* of the display panel 350 depicted in FIG. 8 are implemented as shown in FIG. 3*c*, and described above. In the typical display mode, transistor T3 310*b* is off and the control block 380 controls the row driver 360 so that the Read Select line 352 is driven so as to turn off transistor T3 310*b*. The control block 380 controls the row driver 370 so that the row driver 370 drives the Row Select line 353 of the appropriate row so as to turn on the pixel row. The control block 380 then controls the column drivers 360 so that the appropriate current is driven on the Column Drive line 361 of the pixel. The control block 380 may refresh each row of the display panel 350 periodically, for example 60 times per second.

When the display 395 is in the read mode, the control block 380 controls the row driver 370 so that it drives the Read Select line 352 (for turning on and off the switch, transistor T3 310) and the bias voltage of the read block 315 (and so the voltage of the Read Block line 356) for charging the capacitances to V1 and V2 as required to determine the capacitance 210 of the pixel 200, as described above. The control block 380 performs a read operation to determine the capacitance 210 of each pixel 200 of a pixel circuit 301*b* in a particular row. The control block then uses this information to determine the age of the pixel, and in turn a current correction factor that is to be applied to the driving current.

In addition to the logic for controlling the drivers 360, 370 and read block 315, the control block 380 also comprises logic for determining the current correction factor based on the capacitance 210 as determined with the read block 315. As described above, the current correction factor may be determined using different techniques. For example, if the pixel is measured to determine its initial capacitance and its capacitance after aging for a week, the control block 380 can be adapted to determine the age of a particular capacitance by solving a linear equation defined by the two measured capacitances and ages. If the required current correction factor is measured for a single luminance at each level, than the current correction factor can be determined for a pixel using a look-up table that gives the current correction factor for a particular pixel age. The control block 380 may receive a pixel's capacitance 210 from the read block 315 and determine the pixel's age by solving a linear equation defined by the two measured capacitances for the different ages of the pixel. From the determined age the control block 315 determines a current correction factor for the pixel using a look-up table.

If additional measurements of the pixel aging process were taken, then determining the age of the pixel may not be as simple as solving a linear equation. For example if three points P1, P2 and P3 are taken during the aging process such that the aging is linear between the points P1 and P2, but is exponential or non-linear between points P2 and P3, determining the age of the pixel may require first determining what range the capacitance is in (i.e. between P1-P2, or P2-P3) and then determining the age as appropriate.

The method used by the control block 380 for determining the age of a pixel may vary depending on the requirements of the display. How the control block 380 determines the pixel age and the information required to do so would be programmed into the logic of the control block. The required logic may be implemented in hardware, such as an ASIC (Application Specific Integrated Circuit), in which case it may be more difficult to change how the control block 380 determines the pixel age. The required logic could be implemented in a combination of hardware and software so that it is easier to modify how the control block 380 determines the age of the pixel.

In addition to the various ways to correlate the capacitance to age, the control block 380 may determine the current correction factor in various ways. As previously described, current correction factors may be determined for various luminance levels. Like with the age-capacitance correlation, the current correction factor for a particular luminance level may be extrapolated from the available measurements. Similar to the capacitance-age correlation, the specifics on how the control block 380 determines the current correction factor can vary, and the logic required to determine the current correction factor can be programmed into the control block 380 in either hardware or software Once a current correction factor is determined for a pixel, it is used to scale the driving current as required.

Figure 9:
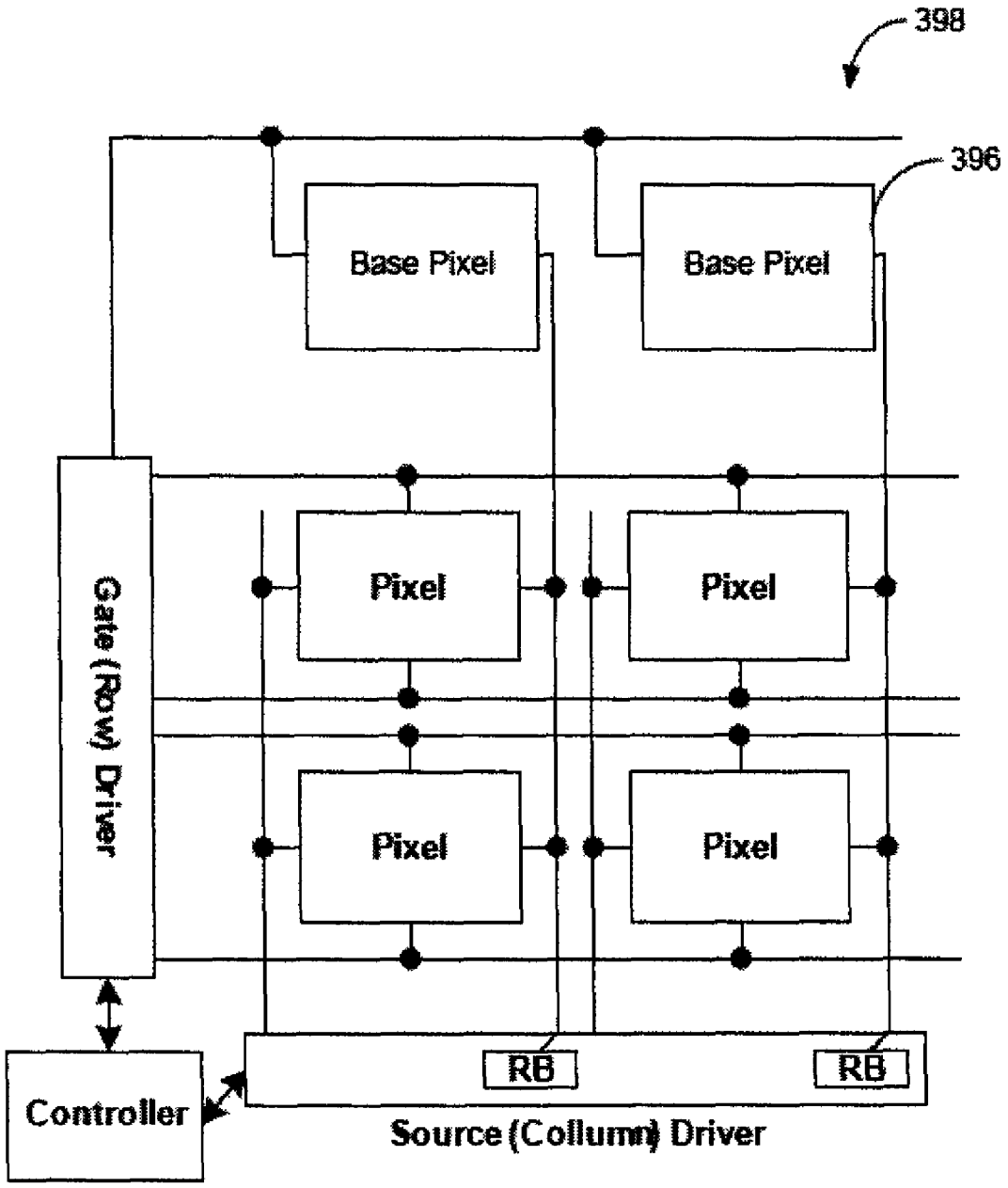
FIG. 9 is a block diagram illustrating an embodiment of a display.

FIG. 9 shows in a block diagram an embodiment of a display 398. The display 390 described above, with reference to FIG. 8, may be modified to correct for pixel characteristics common to the pixel type. For example, it is known that the characteristics of pixels depend on the temperature of the operating environment. In order to determine the capacitance that is the result of aging, the display 398 is provided with an additional row of pixels 396. These pixels 396, referred to as base pixels, are not driven by display currents, as a result they do not experience the aging that the display pixels experience. The base pixels 396 may be connected to the read block 315 for determining their capacitance. Instead of using the pixel capacitance directly, the control block 380 may then use the difference between the pixel capacitance 210 and the base capacitance as the capacitance to use when determining the age of the display pixel.

This provides the ability to easily combine different corrections together. Since the age of the pixel was determined based on a capacitance corrected to account for the base pixel capacitance, the age correction factor does not include correction for non-aging factors. For example, a current correction factor may be determined that is the sum of two current correction factors. The first may be the age-related current correction factor described above. The second may be an operating environment temperature related correction factor.

The control block 380 may perform a read operation (i.e. operate in the read mode) at various frequencies. For example, a read operation may be performed every time a frame of the display is refreshed. It will be appreciated that the time required to perform a read operation is determined by the components. For example, the settling time required for the capacitances to be charged to the desired voltage depends on the size of the capacitors. If the time is large relative to the frame refresh rate of the display, it may not be possible to perform a read each time the frame is refreshed. In this case the control block may perform a read, for example, when the display is turned on or off. If the read time is comparable to the refresh rate it may be possible to perform a read operation once a second. This may insert a blank frame into the display once every 60 frames. However, this may not degrade the display quality. The frequency of the read operations is dependent upon at least the components that make up the display and the required display characteristics (for example frame rate). If the read time is short compared to the refresh rate, a read may be performed prior to driving the pixel in the display mode.

The read block 315 has been described above as determining the capacitance 210 of a single pixel 200 in a row. A single read block 315 can be modified to determine the capacitance of multiple pixels in a row. This can be accomplished by including a switch (not shown) to determine what pixel circuit 301*b* the read block 315 is connected to. The switch may be controlled by the control block 380. Furthermore, although a single read block 315 has been described, it is possible to have multiple read blocks for a single display. If multiple read blocks are used, then the individual read blocks may be referred to as read block elements, and the group of multiple read block elements may be referred to as a read block.

Although the above description describes a circuit for determining the capacitance 210 of a pixel 200, it will be appreciated that other circuits or methods could be used for determining the pixel capacitance 210. For example in place of the voltage amplifier configuration of the read block 315, a transresistance amplifier may be used to determine the capacitance of the pixel. In this case the capacitance of the pixel and the parasitic capacitance is charged using a varying voltage signal, such as a ramp or sinusoidal signal. The resultant current can be measured and the capacitance determined. Since the capacitance is a combination of the parasitic capacitance 330 and the pixel capacitance 210, the parasitic capacitance 330 must be known in order to determine the pixel capacitance 210. The parasitic capacitance 330 may be determined by direct measurement. Alternatively or additionally the parasitic capacitance 330 may be determined using the transresistance amplifier configuration read block. A switch may disconnect the pixel circuit from the read block. The parasitic capacitance 330 would then be determined by charging it with a varying voltage signal and measuring the resultant current.

The embodiments described herein for compensating for the luminance degradation of pixels due to electrical aging can be advantageously included in a display panel without decreasing the yield, aperture ratio or resolution of the display. The electronics required to implement the technique can easily be included in the electronics required by the display without significantly increasing the display size or power requirements.

One or more currently illustrated embodiments have been described by way of example. It will be apparent to persons skilled in the art that a number of variations and modifications can be made without departing from the scope of the invention as defined in the claims.

What is claimed is:

1. A method of compensating for luminance degradation of a pixel having an electroluminescent device, the method comprising:

determining the capacitance of the electroluminescent device;

correlating the determined capacitance of the electroluminescent device to a current correction factor for the electroluminescent device;

compensating a drive current for the electroluminescent device according to the correlated current correction factor; and driving the electroluminescent device with the compensated drive current;

wherein the step of determining the capacitance of the electroluminescent device comprises:

charging the capacitance of the electroluminescent device to a first voltage V1;

charging a parasitic capacitance to a second voltage V2;

electrically connecting the parasitic capacitance and the capacitance of the electroluminescent device in parallel;

and measuring a voltage change, ΔV, across a read capacitor of capacitance $C_{read}$;

wherein the capacitance of the electroluminescent device is equal to:

$$\frac{(\Delta V)(C_{read})}{V2 - V1}.$$

2. The method as claimed in claim 1, wherein the capacitance of the electroluminescent device and the parasitic capacitance are electrically connected in parallel during the charging of the capacitance of the electroluminescent device to V1, and the capacitance of the electroluminescent device and the parasitic capacitance are electrically disconnected during the charging of the parasitic capacitance to V2.

3. The method as claimed in claim 2, further comprising: determining a leakage current of the read capacitor prior to measuring ΔV; determining a resultant voltage based on the leakage current; and deducting the resultant voltage from ΔV.

4. The method as claimed in claim 1, wherein the electroluminescent device is one of a plurality of electroluminescent devices arranged in an array to form a display.

5. A method of driving a pixel with a current compensated for luminance degradation of the pixel, the method comprising:

determining the capacitance of the pixel;

correlating the determined capacitance of the pixel to a current correction factor for the pixel;

compensating a pixel drive current according to the current correction factor;

and driving the pixel with the compensated pixel drive current;

wherein the step of determining the capacitance of the pixel comprises:

charging the capacitance of the pixel to a first voltage V1;

charging a parasitic capacitance to a second voltage V2;

electrically connecting the parasitic capacitance and the capacitance of the pixel in parallel;

and measuring a voltage change, ΔV, across a read capacitor of capacitance $C_{read}$;

wherein the capacitance of the pixel is equal to:

$$\frac{(\Delta V)(C_{read})}{V2 - V1}.$$

6. A display for driving an array of a plurality of pixel circuits with a current compensated for luminance degradation, each of said pixel circuits having an electroluminescent device, the display comprising:

a display panel comprising the array of pixel circuits, the pixel circuits arranged in at least one row and a plurality of columns;

a column driver for driving the electroluminescent device in each pixel circuit of the plurality of pixel circuits with a driving current;

a read block for determining the capacitance of an electroluminescent device and correlating the determined capacitance of the electroluminescent device to a current correction factor for the electroluminescent device; and a control block for controlling the operation of the column driver and the read block, the control block being operable to compensate the driving current based on the correlated current correction factor, and to drive the electroluminescent device with the compensated driving current;

wherein the step of determining the capacitance of the electroluminescent device comprises:

charging the capacitance of the electroluminescent device to a first voltage V1;

charging a parasitic capacitance to a second voltage V2;

electrically connecting the parasitic capacitance and the capacitance of the electroluminescent device in parallel;

and measuring a voltage change, ΔV, across a read capacitor of capacitance $C_{read}$;

wherein the capacitance of the electroluminescent device is equal to:

$$\frac{(\Delta V)(C_{read})}{V2 - V1}.$$

7. The display as claimed in claim 6, further comprising: at least two rows of pixel circuits; and a row driver for selecting the row of pixel circuits to be driven by the column driver.

8. The display as claimed in claim 7, wherein each pixel circuit comprises: an electroluminescent device for emitting light based on the driving current; and a switching transistor, controlled by the row driver for controlling a driving transistor, the driving transistor for driving the electroluminescent device based on the driving current.

9. The display as claimed in claim 8, wherein the electroluminescent device is an organic light emitting diode.

10. The display as claimed in claim 8, wherein the read block comprises:

a plurality of read block elements, each read block element comprising: a switch for electrically connecting and disconnecting the read block element to a pixel circuit of the plurality of pixel circuits; an operational amplifier electrically connected to the switch; and the read capacitor connected in parallel with the operational amplifier.

11. The display as claimed in claim 6, wherein each pixel circuit comprises: a transistor for controlling the driving current from the column driver; and an electroluminescent device for emitting light based on the driving current.

12. The display as claimed in claim 11, wherein the electroluminescent device is an organic light emitting diode.

13. The display as claimed in claim 11, wherein the read block comprises:

a plurality of read block elements, each read block element comprising: a switch for electrically connecting and disconnecting the read block element to a pixel circuit of the plurality of pixel circuits; an operational amplifier electrically connected to the switch; and the read capacitor connected in parallel with the operational amplifier.

14. The display as claimed in claim 6, wherein the control block operates the display in one of at least two modes:

a display mode wherein the control block controls the current driver for driving the plurality of pixel circuits with a driving current based on a display signal and the current correction factor, to emit light;

and a read mode wherein the control block controls the read block to determine the capacitance of the electroluminescent device of a pixel circuit of the plurality of pixel circuits, the control block determining the current correction factor based on the capacitance of the electroluminescent device of the pixel circuit.

* * * * *